US005596169A

United States Patent [19]

Baker et al.

[11] Patent Number: 5,596,169

[45] Date of Patent: Jan. 21, 1997

[54] COMBINED SCSI/PARALLEL PORT CABLE

[75] Inventors: William P. Baker, Salt Lake City; Charles Hamilton, Bountiful, both of Utah

[73] Assignee: Iomega Corporation, Roy, Utah

[21] Appl. No.: 439,776

[22] Filed: May 12, 1995

[51] Int. Cl.[6] ..... H01B 11/02

[52] U.S. Cl. ..... 174/33; 174/34; 341/89; 439/505

[58] Field of Search ..... 174/33, 27, 32, 174/34; 361/686; 439/65; 341/89, 100, 101

[56] References Cited

U.S. PATENT DOCUMENTS

| | | | |
|---|---|---|---|
| 4,603,320 | 7/1986 | Farago | 340/347 DD |
| 4,864,291 | 9/1989 | Korpi | 340/825.5 |
| 4,941,845 | 7/1990 | Eppley et al. | 439/505 X |
| 4,972,470 | 11/1990 | Farago | 380/3 |
| 5,031,115 | 7/1991 | Hayashi | 364/519 |
| 5,099,137 | 3/1992 | Lattin, Jr. | 307/147 |
| 5,101,481 | 3/1992 | Anger et al. | 395/325 |
| 5,119,498 | 6/1992 | McNeill et al. | 395/800 |
| 5,150,465 | 9/1992 | Bush et al. | 395/275 |
| 5,195,022 | 3/1993 | Hoppal et al. | 361/391 X |
| 5,245,558 | 9/1993 | Hachey | 364/708.1 X |
| 5,245,703 | 9/1993 | Hubert | 395/200 |
| 5,289,580 | 2/1994 | Latif et al. | 395/275 |
| 5,321,819 | 6/1994 | Szczepanek | 395/325 |
| 5,457,785 | 10/1995 | Kikinis et al. | 395/308 X |

*Primary Examiner*—Kristine L. Kincaid
*Assistant Examiner*—Chau N. Nguyen
*Attorney, Agent, or Firm*—Woodcock, Washburn, Kurtz, Mackiewicz & Norris

[57] ABSTRACT

A cable for connecting a peripheral device to an input/output port configured in accordance with either a SCSI protocol or a parallel port protocol has a first connector which has a plurality of contact pins for connecting the cable to the peripheral device; a second connector which has a plurality of contact pins for connecting the cable to the input/output port; and a plurality of twisted pairs each having a first conductor and a second conductor. The first conductor of each of the twisted pairs is a data/control line, and the second conductor of the twisted pair is a return for the respective data/control line in accordance with the SCSI protocol. The first and second conductors of each of the twisted pairs are connected between selected pins of the first and second connectors such that none of the twisted pairs carries a data/control signal on both its first and second conductors when the cable is connected to an input/output port that is configured in accordance with the parallel port protocol.

6 Claims, 3 Drawing Sheets

COMBINED SCSI/PARALLEL PORT CABLE

BACKGROUND

1. Field of the Invention

The present invention relates generally to transmission of digital information, and more particularly, to a data transmission cable that can be used interchangeably in both SCSI and parallel port applications.

2. Description of the Prior Art

Computer peripherals, such as printers, modems, disk drives, and the like, are often external to a main computer chassis and must be connected to an input/output port of the computer via a data transmission cable. A connector at one end of the cable connects with the input/output port connector on the computer, while the connector at the other end of the cable connects to the input/output port connector on the peripheral device. The physical and electrical characteristics of a data transmission cable depend upon the type of input/output port protocol for which it must carry data. For example, a cable designed to connect a Small Computer Systems Interface (SCSI) peripheral to the SCSI port of a computer will differ physically and electrically from a cable designed to carry data between a printer and a computer's parallel port.

Prior art cables are available for connecting a SCSI peripheral to the SCSI port of a host computer. These cables come in a variety of connector types and sizes. For example, some prior art SCSI cables employ 50-pin Centronics connectors at each end, while others employ 50-pin High Density connectors. Other prior art SCSI cables are designed to connect a SCSI peripheral to the 25-pin DB SCSI connector typically found on Apple® Macintosh® computers. These prior art cables typically have a male or female DB25 connector at one end, and a 50-pin Centronics® connector at the other end.

Still other prior art SCSI cables have DB25 connectors at both ends. These latter cables typically have a main cable body that comprises 19 twisted pairs, each twisted pair having a first conductor and a second conductor. The first conductor in each of the first eighteen twisted pairs is coupled directly to a respective one of the pins at each end of the cable. These eighteen conductors carry data/control signals in accordance with the SCSI protocol. The second conductor in each of these first eighteen twisted pairs defines a "return" for the respective data/control signal carried on the first conductor of that twisted pair. Pin 25 of the cable is reserved for termination power, and both conductors of the 19th twisted pair are connected to pin 25 to provide increased current carrying capacity for the termination power.

Because eighteen pins are used for data/control signals, and pin 25 is reserved for termination power, there are only six remaining pins to handle the eighteen signal "returns", i.e., the second conductor in each of the first eighteen twisted pairs. Prior art SCSI cables typically distribute the eighteen signal "returns" evenly over the six remaining pins. That is, each of the six remaining pins is tied to three of the eighteen signal "return" conductors. Table 1 illustrates the even distribution of "returns" in a prior art SCSI cable. As shown, pins 7, 9, 14, 16, 18 and 24 each share three of the eighteen signal return conductors in the prior art SCSI Cable.

TABLE 1

| Prior Art SCSI Cable | |
|---|---|
| PIN # | SCSI FUNCTION |
| 1 | REQ |
| 2 | MSG |
| 3 | I/O |
| 4 | RST |
| 5 | ACK |
| 6 | BSY |
| 7 | ACK Return |
| | BSY Return |
| | ATN Return |
| 8 | DBO |
| 9 | MSG Return |
| | RST Return |
| | SEL Return |
| 10 | DB3 |
| 11 | DB5 |
| 12 | DB6 |
| 13 | DB7 |
| 14 | DB0 Return |
| | DB1 Return |
| | DB2 Return |
| 15 | C/D |
| 16 | DB3 Return |
| | DB5 Return |
| | DB4 Return |
| 17 | ATN |
| 18 | DB6 Return |
| | DB7 Return |
| | DBP Return |
| 19 | SEL |
| 20 | DBP |
| 21 | DB1 |
| 22 | DB2 |
| 23 | DB4 |
| 24 | REQ Return |
| | I/O Return |
| | C/D Return |
| 25 | TERM PWR |

Prior art parallel port cables that employ DB25 connectors at each end typically comprise only twenty-five single conductors connected to respective pins at each end of the cable. Table 2 shows how the 25 pins/conductors of a parallel port cable are defined and provides a comparison of the parallel port pin definitions to those of a prior art SCSI cable.

TABLE 2

| Comparison of Prior Art Parallel Port Cable to Prior Art SCSI Cable. | | |
|---|---|---|
| PIN # | PP FUNCTION | SCSI FUNCTION |
| 1 | nSTROBE | REQ |
| 2 | D1 | MSG |
| 3 | D2 | I/O |
| 4 | D3 | RST |
| 5 | D4 | ACK |
| 6 | D5 | BSY |
| 7 | D6 | ACK Return |
| | | BSY Return |
| | | ATN Return |
| 8 | D7 | DB0 |
| 9 | D8 | MSG Return |
| | | RST Return |
| | | SEL Return |
| 10 | nACK | DB3 |
| 11 | BUSY | DB5 |
| 12 | ERROR | DB6 |
| 13 | SELECT | DB7 |
| 14 | nAFEED | DB0 Return |
| | | DB1 Return |

TABLE 2-continued

Comparison of Prior Art Parallel Port Cable to Prior Art SCSI Cable.

| PIN # | PP FUNCTION | SCSI FUNCTION |
|---|---|---|
| | | DB2 Return |
| 15 | nFAULT | C/D |
| 16 | nINIT | DB3 Return |
| | | DB5 Return |
| | | DB4 Return |
| 17 | nSELECT IN | ATN |
| 18 | GROUND | DB6 Return |
| | | DB7 Return |
| | | DBP Return |
| 19 | GROUND | SEL |
| 20 | GROUND | DBP |
| 21 | GROUND | DB1 |
| 22 | GROUND | DB2 |
| 23 | GROUND | DB4 |
| 24 | GROUND | REQ Return |
| | | I/O Return |
| | | C/D Return |
| 25 | GROUND | TERM PWR |

Despite the common connector sizes (i.e., DB25 ) in both prior art SCSI and parallel port cables, a 25-pin prior art SCSI cable cannot be used in parallel port applications because the even distribution of "return" conductors over pins 7, 9, 14, 16, 18 and 24 of the prior art SCSI cable will cause signal integrity problems when such a cable is employed in connection with a parallel port. Specifically, because of the way the return conductors are distributed evenly over pins 7, 9, 14, 16, 18 and 24, the first and second conductors of certain twisted pairs of a prior art SCSI cable will both carry data/control signals when used in connection with a parallel port. As a result, crosstalk may occur over certain twisted pairs.

FIG. 1 is a partial schematic diagram of a prior art SCSI cable that illustrates the problems encountered when such a cable is employed in a parallel port application. The prior art SCSI cable has a first DB25 connector 221 at one end, and a second DB25 connector 223 at the other end. The main body of the cable comprises 19 twisted pairs, e.g., 220, 222, 224, 226 and 228. Each twisted pair has a first conductor, denoted by the letter "a", and a second conductor denoted by the letter "b". As shown, the first conductor 220*a* of one of the twisted pairs 220 is connected to pin 1 of each connector 221, 223, while the second, or "return", conductor 220*b* is connected to pin 24. Both the first and second conductors 228*a*, 228*b* of a nineteenth twisted pair 228 are connected to pin 25 of each connector 221, 223 in order to carry the SCSI termination power.

The first conductors 222*a*, 224*a*, 226*a* of twisted pairs 222, 224 and 226 are connected to pins 5, 6 and 17, respectively. The second, or "return", conductor 222*b*, 224*b* and 226*b* of each twisted pair 222, 224, 226 is connected to pin 7. As shown in Table 1, pins 5, 6 and 17 are used to carry the ACK, BSY and ATN control signals of the SCSI protocol, while pin 7 provides the "return" for each of those signals. Other data and control signals are carried on other twisted pairs (not shown) and the return conductors for each of those other twisted pairs is tied to either pin 9, 14, 16, 18 or 24. For example, as illustrated in both FIG. 1 and Table 1, pin 24 is connected to the "return" conductor for pins 1, 3 and 15.

To illustrate the problem of using such a prior art cable in parallel port applications, consider pins 5, 6 and 17. Pin 5 of the prior art SCSI cable is tied to the first conductor 222*a* of twisted pair 222 in order to carry the SCSI "ACK" control signal. The second, or "return", conductor 222*b* of that twisted pair is tied to pin 7. On a parallel port, pins 5 and 7 are both defined to carry data signals, i.e., DB4 and DB6, respectively. Consequently, if the prior art SCSI cable were employed to transmit signals between two parallel ports, the data signals transmitted on pins 5 and 7 would travel down the respective first and second conductors 222*a*, 222*b* of the same twisted pair 222. As a result, these signals may interfere with each other causing data integrity problems. Similarly, because pin 7 is also tied to the return conductors for pins 6 and 17, parallel port data transmitted on pin 7 could also interfere with the data and control signals on pins 6 and 17 (i.e., DB5 and nSELECT IN) of a parallel port. Crosstalk on these common "returns" can cause a parallel port peripheral to malfunction.

As the foregoing illustrates, therefore, a prior art SCSI cable cannot be used to connect a peripheral device to a host device via respective parallel ports. Users of parallel port and SCSI equipment must purchase separate cables for each application. Consequently, there is a need for a single cable that can be used in connection with either a parallel port or SCSI port. The present invention satisfies this need.

SUMMARY OF THE INVENTION

The present invention is directed to a cable for connecting a peripheral device to an input/output port configured in accordance with either a SCSI protocol or a parallel port protocol. The cable can therefore be used interchangeably in both SCSI and parallel port applications. The cable of the present invention comprises a first connector having a plurality of contact pins for connecting the cable to the peripheral device, a second connector having a plurality of contact pins for connecting the opposite end of the cable to the input/output port, and a plurality of twisted pairs. Each twisted pair comprises a first conductor and a second conductor. The first conductor of each of the plurality of twisted pairs defines a data/control line, and the second conductor of the twisted pair defines a return for the respective data/control line in accordance with the SCSI protocol. According to the present invention, the first and second conductors of each of the twisted pairs is connected between selected pins of the first and second connectors such that none of the twisted pairs carries a data/control signal on both its first and second conductors when the input/output port is configured in accordance with a parallel port protocol. Preferably, the first and second conductors of a selected one of the twisted pairs are both connected, at each end of the cable, to a single pin on each of the first and second connectors for providing increased current capacity between the respective single pins on each connector for carrying termination power over the cable in accordance with the SCSI protocol.

In a preferred embodiment, the first and second connectors each comprise 25-pin DB connectors, and the plurality of twisted pairs comprises nineteen (19) twisted pairs. The first conductor of each of the first eighteen twisted pairs is defined to carry a data/control signal in accordance with the SCSI protocol, and the second conductor of each of those eighteen twisted pairs defines a return for the respective data/control signal carried on the first conductor of that twisted pair. Each of the first conductors of the eighteen twisted pairs is connected, at each end of the cable, to a respective pin of the first and second connectors. Each of the second conductors of those eighteen twisted pairs is connected, at each end of the cable, to one of six remaining pins of the first and second connectors. According to the present invention, the second conductors of those eighteen twisted pairs are distributed over the six remaining pins such that when the cable is connected to an input/output port configured in accordance with a parallel port protocol, none of the eighteen twisted pairs carries a data/control signal on both its first and second conductors. Preferably, the first and second conductors of the nineteenth twisted pair are both connected, at each end of the cable, to the twenty-fifth pin on each of the first and second connectors for providing increased current capacity. Pin 25 carries termination power in accordance with the SCSI protocol.

These and other features and advantages of the present invention will become evident hereinafter.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings embodiments that are presently preferred, it being understood, however, that the invention is not limited to the specific methods and instrumentalities disclosed. In the drawings.

DETAILED DESCRIPTION OF THE PREFERRED EMBODIMENT

Figure 1:
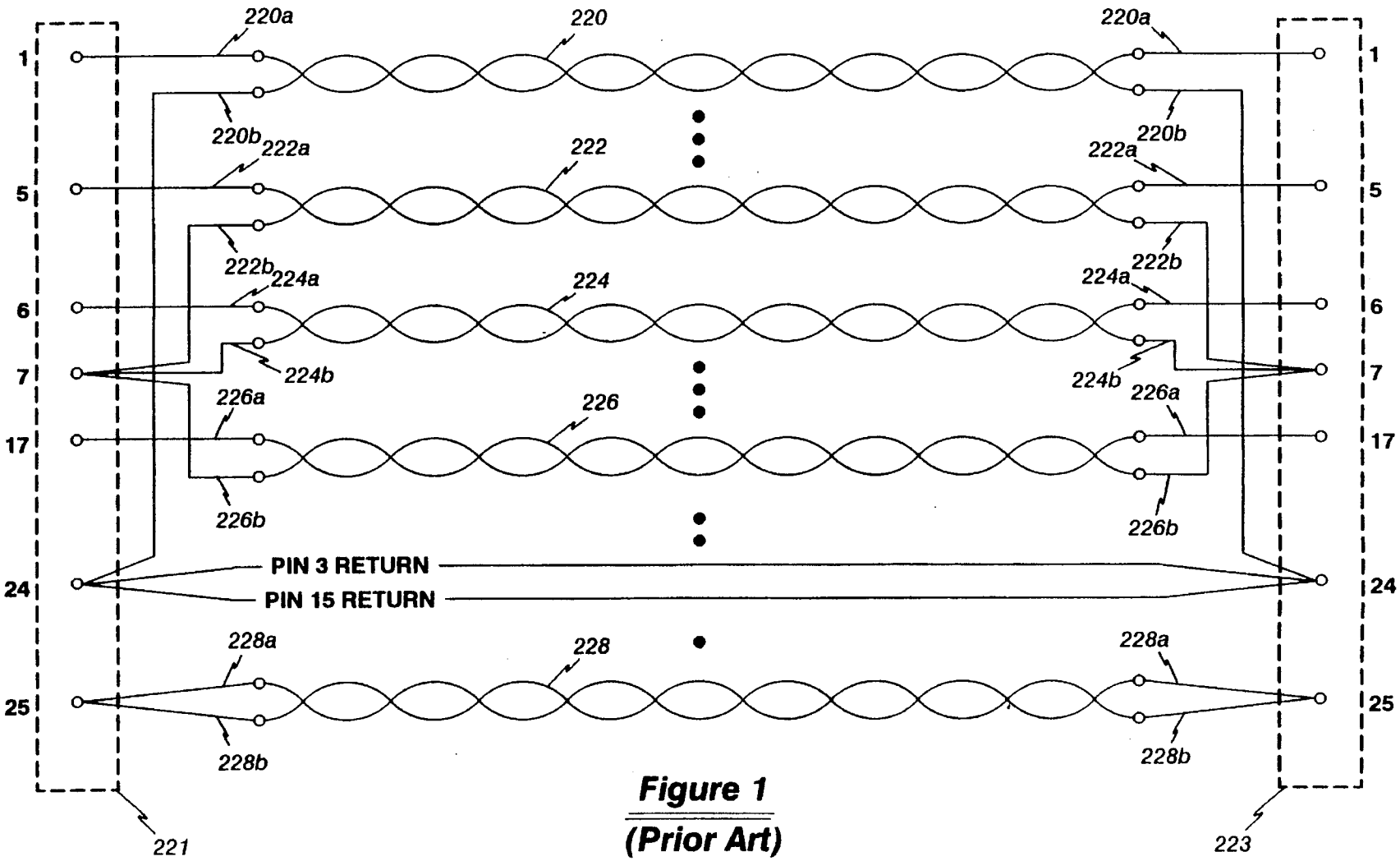
Figure 1 (Prior Art)
FIG. 1 is a partial schematic diagram of a prior art SCSI cable.
Figure 2:
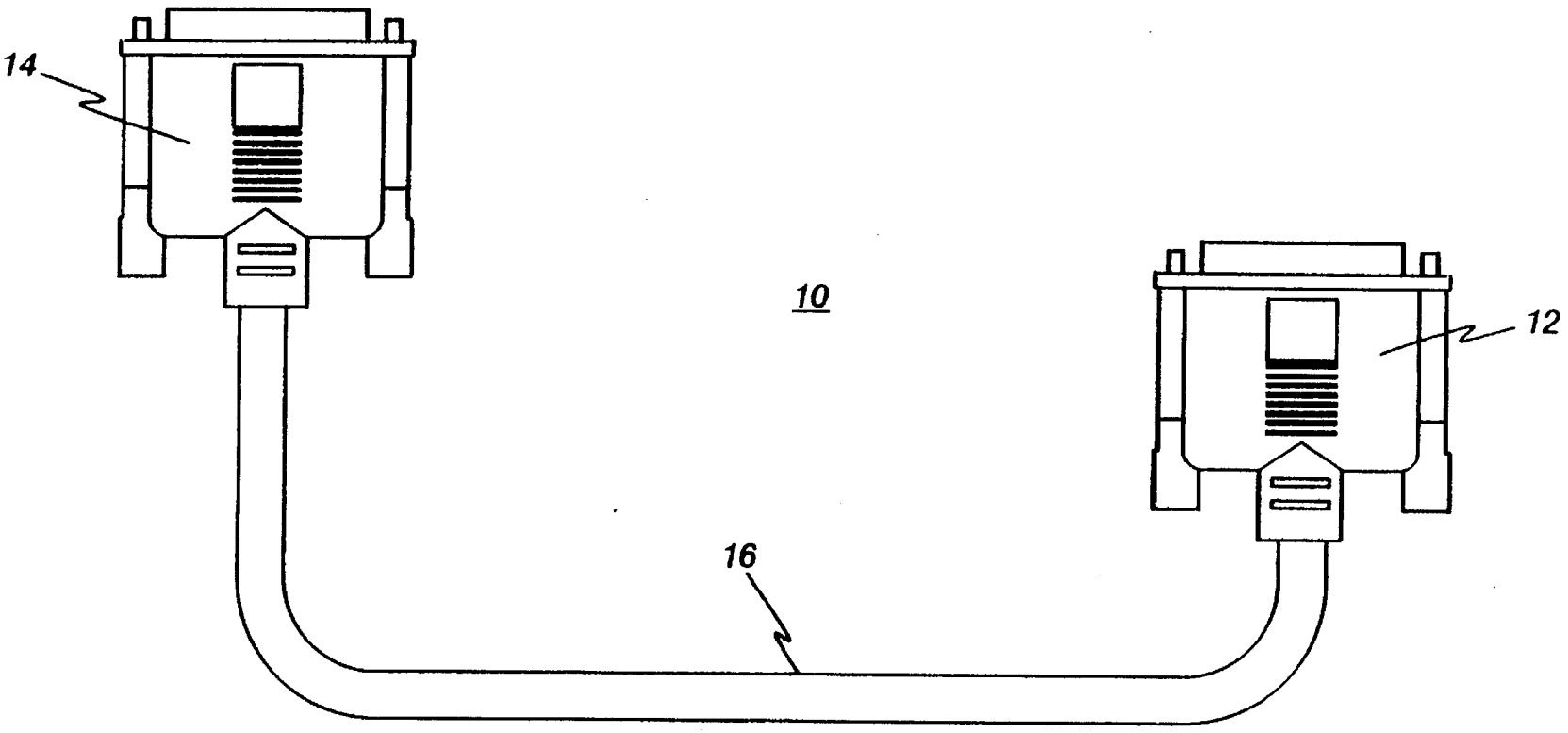
FIG. 2 is a plan view of a combined SCSI/Parallel Port cable in accordance with the present invention.

Referring to the drawings wherein like numerals indicate like elements throughout, there is shown in FIG. 1 a combined SCSI/parallel port cable 10 that, in accordance with the present invention, can be used interchangeably in both SCSI and parallel port applications. The combined SCSI/Parallel Port cable of the present invention eliminates the crosstalk problems that prevent prior art SCSI cables from being used in parallel port applications.

As shown in FIG. 1, the cable 10 comprises a first connector 12 having a plurality of contact pins for connecting the cable 10 to the input/output port of a host computer (not shown), and a second connector 14 having a like number of pins for connecting the cable to the mating connector (not shown) on a peripheral device (not shown). In the preferred embodiment, each of the connectors 12, 14 comprises a 25-pin DB connector. It is understood, however, that other connector types and sizes may be employed. For example, the connector at either end of the cable could comprise a 36-pin Centronics®, 36-pin High Density, 50-pin Centronics® or 50-pin High Density connector.

The cable 10 further comprises a main body 16 that comprises a plurality of twisted pairs, each having a first conductor and a second conductor. The first conductor of each twisted pair defines a data/control line and the second conductor of the twisted pair defines a "return" for the respective data/control line in accordance with a SCSI protocol, such as the SCSI-2 protocol. According to the present invention, the first and second conductors of each of the twisted pairs is connected between selected pins of the first and second connectors such that none of the twisted pairs carries a data/control signal on both its first and second conductors when the input/output port to which the cable is connected is configured in accordance with a parallel port protocol.

In SCSI applications, the terms "data/control line" and "data/control signal" include, without limitation, the following control and data signals defined in accordance with the SCSI-1, 2 and 3 protocols: REQ, MSG, I/O, RST, ACK, BSY, C/D, ATN, SEL, DBO, DB1, DB2, DB3, DB4, DB5, DB6, DB7, DBP, TERM PWR. In parallel port applications, the terms "data/control line" and "data/control signal" include, without limitation, the following control and data lines defined in accordance with the various parallel port protocols (e.g., unidirection, bi-directional, ECP, EPP, IEEE-1284): nSTROBE, D1, D2, D3, D4, D5, D6, D7, D8, nACK, BUSY, ERROR, SELECT, nAFEED, nFAULT, nINIT, nSELECT IN.

In a preferred embodiment, the main body 16 of the cable 10 comprises nineteen (19) twisted pairs. Eighteen (18) of the twisted pairs serve as signal/return lines in accordance with the SCSI protocol, while the nineteenth twisted pair is used to carry SCSI termination power. Each of the first conductors of the first eighteen twisted pairs is connected, at each end of the cable, to a respective pin of the first and second connectors 12, 14. Both the first and second conductors of the nineteenth twisted pair are connected, at each end of the cable, to a single pin (i.e., pin #25) for carrying termination power. Each of the second conductors of the first eighteen twisted pairs is connected, at each end of the cable, to one of six remaining pins of the first and second connectors 12, 14. According to the present invention, the second conductors of these eighteen twisted pairs are distributed over the six remaining pins such that when the cable is connected to an input/output port configured in accordance with a parallel port protocol, none of the eighteen twisted pairs carries a data/control signal on both its first and second conductors. As a result, crosstalk problems are eliminated, and the cable can be used interchangeably in both SCSI and parallel port applications.

Table 3 illustrates the distribution of second, or "return" conductors, over the six remaining pins 7, 9, 14, 16, 18 and 24 in accordance with the preferred embodiment of the present invention. For convenience, the function of each pin is provided for both parallel port and SCSI applications. The present invention recognizes that pins 18 and 24 are defined as grounds/returns in accordance with both the SCSI and parallel port protocols. This recognition is exploited while maintaining the ground/return integrity requirements of the SCSI protocol.

As shown in Table 3, the first conductors of each of the first eighteen twisted pairs are connected, respectively, to pins 1–6, 8, 10–13, 15, 17 and 19–23. Pin 7 is connected solely to the second conductor of the twisted pair whose first conductor is connected to pin 22 (i.e., DB2 and DB2 Return). Likewise, pins 9, 14, and 16 are connected solely to the returns for pins 21, 20 and 23, respectively.

TABLE 3

| Combined SCSI/Parallel Port Cable 10 | | |
|---|---|---|
| PIN # | SCSI Function | PP Function |
| 1 | REO | nSTROBE |
| 2 | MSG | D1 |
| 3 | I/O | D2 |
| 4 | RST | D3 |

TABLE 3-continued

| Combined SCSI/Parallel Port Cable 10 | | |
|---|---|---|
| PIN # | SCSI Function | PP Function |
| 5 | ACK | D4 |
| 6 | BSY | D5 |
| 7 | DB2 Return | D6 |
| 8 | DB0 | D7 |
| 9 | DB1 Return | D8 |
| 10 | DB3 | nACK |
| 11 | DB5 | BUSY |
| 12 | DB6 | ERROR |
| 13 | DB7 | SELECT |
| 14 | DBP Return | nAFEED |
| 15 | C/D | nFAULT |
| 16 | DB4 Return | nINIT |
| 17 | ATN | n SELECT IN |
| 18 | DB0 Return | GROUND |
| | DB3 Return | |
| | DB5 Return | |
| | DB6 Return | |
| | DB7 Return | |
| | ACK Return | |
| | ATN Return | |
| 19 | SEL | GROUND |
| 20 | DBP | GROUND |
| 21 | DB1 | GROUND |
| 22 | DB2 | GROUND |
| 23 | DB4 | GROUND |
| 24 | BSY Return | GROUND |
| | C/D Return | |
| | I/O Return | |
| | MSG Return | |
| | REO Return | |
| | RST Return | |
| | SEL Return | |
| 25 | TERM PWR | GROUND |

Pin 18, however, is connected to the second conductors of the twisted pairs whose first conductors are connected to pins 5, 8, 10–13 and 17. Similarly, pin 24 is connected to the returns for pins 1–4, 6, 15 and 19. Unlike prior art SCSI cables, therefore, the eighteen return conductors of the cable 10 of the present invention are not evenly distributed over pins 7, 9, 14, 16, 18 and 24.

As illustrated in Table 3, the distribution of return conductors over pins 7, 9, 14, 16, 18 and 24 in accordance with the present invention ensures that when the cable is connected to an input/output port configured in accordance with a parallel port protocol, none of the eighteen twisted pairs carries a parallel port data or control signal on both its first and second conductors. As shown in Table 3, only pins 1–17 of a parallel port carry data signals; pins 18–25 are defined as grounds. The distribution of return conductors in accordance with the present invention ensures that pins 1–17 are each connected to only one conductor of a respective twisted pair. Accordingly, the combined SCSI/parallel port cable of the present invention can be used interchangeably in both SCSI and parallel port applications without the undesirable crosstalk that occurs with prior art SCSI cables.

Figure 3:
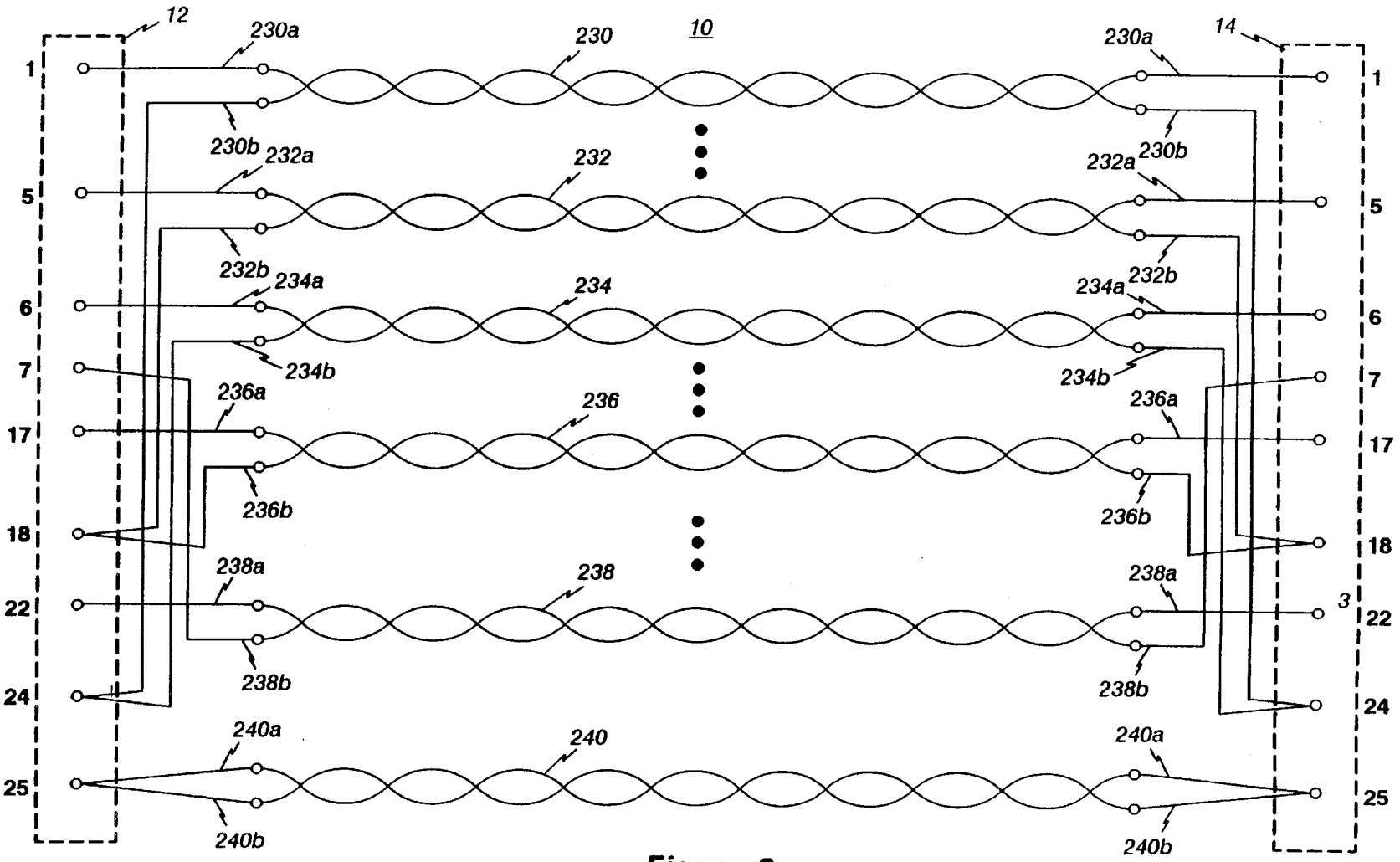
FIG. 3 is a partial schematic diagram of the combined SCSI/Parallel Port cable of FIG. 2.

FIG. 3 is a partial schematic diagram of the preferred embodiment of the combined SCSI/parallel port cable of the present invention, illustrating the connection of selected twisted pairs, e.g., twisted pairs 230, 232, 234, 236, 238 and 240, to pins 1, 5–7, 17, 18, 22, 24 and 25. Each twisted pair 230–240 has a first conductor designated with the letter "a", and a second conductor (i.e., "return") designated with the letter "b". FIG. 3 highlights the differences between the combined SCSI/parallel port cable 10 of the present invention and a typical prior art SCSI cable, such as that shown in FIG. 1.

As shown, in the combined SCSI/parallel port cable 10 of the present invention, each of pins 1–17 of the first and second connectors 12, 14 is connected to only one of the first and second conductors of any given twisted pair. This is achieved by connecting the majority of the second conductors of the first eighteen twisted pairs to pins 18 and 24, the only two common grounds/returns among both SCSI and parallel port protocols. As a result, when the cable is connected to an input/output port configured in accordance with a parallel port protocol, none of the first eighteen twisted pairs carries a parallel port data or control signal (i.e., non-ground) on both its first and second conductors. For example, the first conductor 238*a* of twisted pair 238 is connected to pin 22, and the second conductor 238*b* is connected to pin 7. Pin 7 of a parallel port carries a data signal (i.e., DB4). Pin 22 is defined as a ground. Accordingly, twisted pair 238 carries a data signal on only one of its first and second conductors 238*a*, 238*b*. This is true of each other twisted pair as well.

As the foregoing illustrates, the present invention is directed to a combined SCSI/parallel port cable that can be used interchangeably in both SCSI and parallel port applications. It is understood that changes may be made to the embodiments described above without departing from the broad inventive concepts thereof. Accordingly, the present invention is not limited to the particular embodiments disclosed, but is intended to cover all modifications that are within the spirit and scope of the invention as defined by the appended claims.

What is claimed is:

1. A cable for connecting a peripheral device to an input/output port configured in accordance with one of a SCSI protocol and a parallel port protocol, said cable comprising:

a first connector having a plurality of contact pins for connecting said cable to said peripheral device;

a second connector having a plurality of contact pins for connecting said cable to said input/output port; and a plurality of twisted pairs, each twisted pair comprising a first conductor and a second conductor, the first conductor of each of said plurality of twisted pairs defining a data/control line and the second conductor of that twisted pair defining a return for the respective data/control line in accordance with said SCSI protocol, the first and second conductors of each of said twisted pairs being connected between selected pins of the first and second connectors such that none of said twisted pairs carries a data/control signal on both its first and second conductors when the cable is connected to said input/output port that is configured in accordance with said parallel port protocol.

2. The cable recited in claim 1, wherein the first and second conductors of a selected one of said twisted pairs are both connected, at each end of said cable, to a single pin on each of said first and second connectors for providing increased current capacity between the respective single pins on each connector for carrying termination power over said cable in accordance with the SCSI protocol.

3. The cable recited in claim 1, wherein each of said first and second connectors comprises a 25-pin connector, and wherein said plurality of twisted pairs comprises nineteen twisted pairs.

4. A cable for connecting a peripheral device to an input/output port configured in accordance with one of a SCSI protocol and a parallel port protocol, said cable comprising:

first and second connectors each comprising twenty-five contact pins; and nineteen twisted pairs, each twisted pair comprising a first conductor and a second conductor, the first conductor of each of eighteen of said nineteen twisted pairs being defined to carry data/control signals in accordance with said SCSI protocol and the second conductor of each of said eighteen twisted pairs defining a signal return for the respective data/control signal carried on the first conductor of that twisted pair, each of the first conductors of said eighteen twisted pairs being connected, at each end of said cable, to a respective pin of said first and second connectors, each of the second conductors of said eighteen twisted pairs being connected, at each end of the cable, to one of six remaining pins of said first and second connectors, the second conductors of said eighteen twisted pairs being distributed over said six remaining pins such that when said cable is connected to an input/output port configured in accordance with said parallel port protocol, none of said eighteen twisted pairs carries one of said data/control signals on both its first and second conductors.

5. The cable recited in claim 4, wherein the first and second conductors of a nineteenth one of said twisted pairs are both connected, at each end of said cable, to a single pin on each of said first and second connectors for providing increased current capacity between said single pins on each connector for carrying termination power in accordance with said SCSI protocol.

6. The cable recited in claim 4 wherein said first and second connectors each comprise a D-type connector.

* * * * *